US006402550B2

(12) United States Patent
Matsubara

(10) Patent No.: US 6,402,550 B2
(45) Date of Patent: Jun. 11, 2002

(54) COAXIAL CABLE CONNECTOR WITH MAIN BODY TIGHTLY FASTENED TO PROTECTIVE COATING

(75) Inventor: Hiroshi Matsubara, Nisshin (JP)

(73) Assignee: Maspro Denkoh, Co., LTD, Aichi (JP)

( * ) Notice: Subject to any disclaimer, the term of this patent is extended or adjusted under 35 U.S.C. 154(b) by 0 days.

(21) Appl. No.: 09/833,155

(22) Filed: Apr. 11, 2001

(30) Foreign Application Priority Data

Apr. 14, 2000 (JP) ..... 2000-114189

(51) Int. Cl.[7] ..... H01R 9/05
(52) U.S. Cl. ..... 439/578
(58) Field of Search ..... 439/578, 583, 439/584, 585, 805, 610, 98

(56) References Cited

U.S. PATENT DOCUMENTS

| | | | | |
|---|---|---|---|---|
| 3,710,005 A | * | 1/1973 | French | 174/89 |
| 3,781,762 A | * | 12/1973 | Quackenbush | 439/578 |
| 4,053,200 A | * | 10/1977 | Pugner | 439/578 |
| 5,609,501 A | * | 3/1997 | McMills et al. | 439/578 |

FOREIGN PATENT DOCUMENTS

| | | |
|---|---|---|
| JP | 5254782 | 4/1977 |
| JP | 57105985 | 7/1982 |

* cited by examiner

*Primary Examiner*—Brian Sircus
*Assistant Examiner*—Son V. Nguyen
(74) *Attorney, Agent, or Firm*—Pearson & Pearson LLP

(57) ABSTRACT

A coaxial cable connector for mounting to an end portion of a coaxial cable (20) including a braided conductor (7) and a laminate foil (6) provided inside the braided conductor (7) and having a center conductor. The coaxial cable connector comprises a cylindrical connector main body (30) inserted between the braided conductor (7) and the laminate foil (6), a connective cylinder (2) rotatably supported to a proximal portion of the connector main body (30) so as to be engaged with an outer conductor of a mating connector to be connected, and a clamp ring (3) for fixedly fastening an insertion member (11) of the connector main body (30) after being inserted into the coaxial cable (20). The cylindrical connector main body (30) may also be inserted between the braided conductor (7) and a protective coating (8) portion provided outside the braided conductor (7). Further, the connector main body (30) may comprise slots (41) at the insertion distal portion **(11*a*)**.

3 Claims, 6 Drawing Sheets

COAXIAL CABLE CONNECTOR WITH MAIN BODY TIGHTLY FASTENED TO PROTECTIVE COATING

BACKGROUND OF THE INVENTION

1. Field of the Invention

The present invention relates to a coaxial cable connector, which is mounted to a coaxial cable including a braided conductor and a laminate foil inside the braided conductor and having a conductivity in the case of connecting the coaxial cable with a terminal of equipment or the like.

2. Description of the Related Art

Conventionally, as this kind of coaxial cable connector, there has been known connectors disclosed in Unexamined Patent Publication (Kokai) No.57-105985 or Examined Utility Model Publication 52-54782. In the connector disclosed in the above Publication 57-105985, an electrical and mechanical connection with a coaxial cable is made in the following manner. More specifically, a plurality of conductor pieces is provided so as to cover an exposed braided conductor member, and then, is fixedly fastened using a clamp ring. On the other hand, in the connector disclosed in the above Publication 52-54782, an electrical and mechanical connection with a coaxial cable is made in the following manner. More specifically, a protective coating member and an exposed braided conductor member are inserted into a spiral threaded portion formed at an inner surface of connector so as to be screwed to a connector.

However, in the connector disclosed in the former publication, the braided conductor member is securely fastened to an outer conductor of the connector, but a gap is formed between the outer conductor of the connector and a laminate foil, and also, a gap is formed between the conductor pieces. For this reason, a noise such as a stray radio wave intrudes from these gaps, and an internal signal leaks from there; as a result, a new noise is generated. On the other hand, in the connector disclosed in the latter publication, the connector is mounted by only engagement utilizing an elasticity at the braided conductor member and the protective coating member of the coaxial cable. For this reason, a mechanical jointing strength is low; for example, it is impossible to permanently use the connector under outdoor environment as used in a CATV system.

SUMMARY OF THE INVENTION

The present invention has been made in view of the problems in the prior art. It is, therefore, an object of the present invention to provide a coaxial cable connector, which can perform a connection excellent in a fixing force without generating a nose intrusion or radiation.

In order to achieve the above object, according to a first aspect, the present invention provides a coaxial cable connector, which is mounted to an end portion of a coaxial cable including a braided conductor and a laminate foil provided inside the braided conductor and having a conductivity, comprising:

- a cylindrical connector main body inserted between the braided conductor and the laminate foil;
- a connective cylinder rotatably supported to a proximal portion of the connector main body so as to be engaged with an outer conductor of another object to be connected; and
- a clamp ring for fixedly fastening an insertion member of the connector main body after being inserted into the coaxial cable.

Further, according to a second aspect, the present invention provides the coaxial cable connector according to the first aspect, wherein a distal end portion of the connector main body inserted into the coaxial cable is formed with a slot.

Further, according to a third aspect, the present invention provides a coaxial cable connector, which is mounted to an end portion of a coaxial cable including a braided conductor and a laminate foil provided inside the braided conductor and having a conductivity, comprising:

- a cylindrical connector main body inserted between the braided conductor and a protective coating portion provided outside the braided conductor;
- a connective cylinder rotatably supported to a proximal portion of the connector main body so as to be engaged with an outer conductor of another object to be connected; and
- a clamp ring for fixedly fastening an insertion member of the connector main body after being inserted into the coaxial cable,
- a distal end portion of the connector main body inserted into the coaxial cable being formed with a slot.

Further, according to a fourth aspect, the present invention provides the coaxial cable connector according to any of the first to third aspect, wherein a ridge portion is formed at an outer peripheral portion in the vicinity of the distal portion of the connector main body.

Further, according to a fifth aspect, the present invention provides the coaxial cable connector according to any of the first to fourth aspect, wherein an inner surface of the connector main body is formed with a spiral protrusion.

BRIEF DESCRIPTION OF THE DRAWINGS

FIG. 4(*a*) is a front view showing the coaxial cable connector;

FIG. 4(*b*) is a side view showing the same;

FIG. 4(*c*) is a side view partially in section showing a state that the connector is inserted and mounted to a coaxial cable;

FIG. 5(*a*) is a front view showing the coaxial cable connector;

FIG. 5(*b*) is a side view showing the same;

FIG. 5(*c*) is a side view partially in section showing a state that the connector is inserted and mounted to a coaxial cable;

FIG. 6(*a*) is a front view showing the coaxial cable connector;

FIG. 6(*b*) is a side view showing the same;

FIG. 6(*c*) is a side view partially in section showing a state that the connector is inserted and mounted to a coaxial cable;

FIG. 7(*a*) is a front view showing the coaxial cable connector;

FIG. 7(*b*) is a side view showing the same;

FIG. 7(*c*) is a side view partially in section showing a state that the connector is inserted and mounted to a coaxial cable.

DETAILED DESCRIPTION OF THE PREFERRED EMBODIMENTS

Preferred embodiments of the present invention will be detailedly described below with reference to the accompanying drawings.

Figure 1:
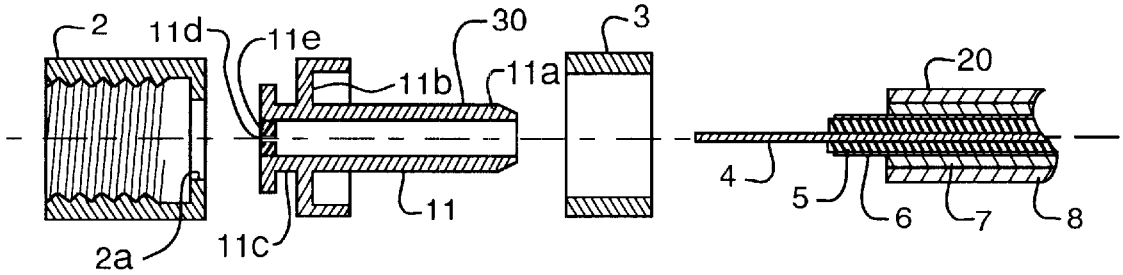
FIG. 1 is a cross sectional view showing an exploded state of a coaxial cable connector according to a first embodiment of the present invention.

FIG. 1 is a cross sectional view showing an exploded state of a coaxial cable connector according to a first embodiment of the present invention. In FIG. 1, a reference numeral 2 denotes a connective cylinder, 3 denotes a clamp ring, 20 denotes a coaxial cable coated with an aluminum laminate foil 6, and 30 denotes a connector main body.

The coaxial cable connector comprises an insertion member 11, a connector main body 30, a connective cylinder 2 and a clamp ring 3. The insertion member 11 inserted into the coaxial cable 20 has an insertion distal portion 11*a*, which is formed into a shape easy to be inserted such as tapered sharp. The connective cylinder 2 and the clamp ring 3 are used to connect the connector main body 30, which has an insertion stopper portion 11*b* for inserting and fixing a protective coating portion 8 and is formed out of a conductive material, with another object to be connected. The insertion member 11 is interposed between the aluminum laminate foil 6 and a braided conductor 7 of the coaxial cable 20, and fixedly fastened using the clamp ring 3 after the insertion to the coaxial cable 20 is completed. The most depth portion of the insertion member 11 is provided with an inner insulator stopper portion 11*e* formed out of an insulating material. Further, the most depth portion of the insertion member 11 is formed with a core wire hole lid for inserting a core wire 4, which is an inner conductor of the coaxial cable 20, at a position corresponding to an axial line of cylinder. The connector main body 30 is formed with a groove around the proximal portion thereof, that is, a proximal groove 11*c*, into which the connective cylinder 2 is fitted.

The connective cylinder 2 is a cylindrical outer conductor formed of a conductive material, as well as the connector main body 30. Further, the connective cylinder 2 is formed with a projected portion 2*a*, which is bent inwardly over the entire circumference of one opening end portion thereof. In a state that the projected portion 2*a* is engaged with the proximal groove 11*c* of the connector main body 30, the connective cylinder 2 is rotatably supported to the connector main body 30. In this state, the connective cylinder 2 and the connector main body 30 conductively contact with each other and their central axis is correspondent. The clamp ring 3 is a fixedly fastening member for mounting the coaxial cable 20 and the connector main body 30. In this case, the coaxial cable 20 is a laminate type coaxial cable having the following structure. More specifically, the coaxial cable comprises: a core wire 4 which is an inner conductor; a braided conductor 7 which is an outer conductor, an internal insulator 5 interposed between the core wire 4 and the braided conductor 7, and a protective coating portion 8 covering these elements. Incidentally, the protective coating portion 8 is an external insulator. Further, the internal insulator 5 is covered with an aluminum laminate foil 6 at its outer peripheral surface. The aluminum laminate foil 6 is added to the braided conductor 7, which is an outer conductor so as to improve a shield effect. In this case, the aluminum laminate foil 6 may be replaced with an aluminum pipe, which is excellent in a shield effect and moisture-proof performance.

Figure 2:
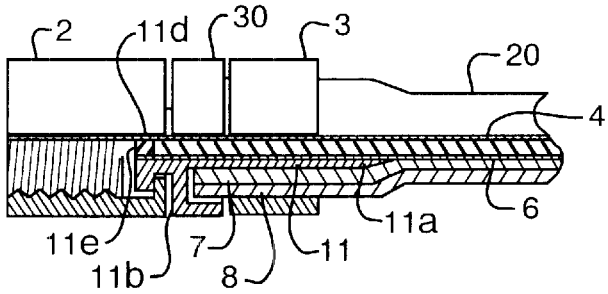
FIG. 2 is a side view partially in section showing a state that a connector main body shown in FIG. 1 is mounted to a coaxial cable.
Figure 3:
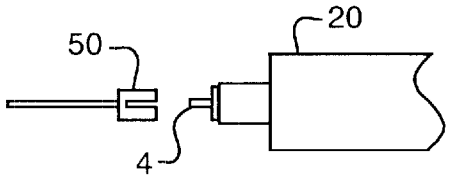
FIG. 3 is a side view showing a contact pin usable as a core conductor.

FIG. 2 is a side view partially in section showing a state that the connector main body shown in FIG. 1 is mounted to a coaxial cable 20. The procedure of mounting the connector of the present invention to the coaxial cable 20 will be described below with reference to FIG. 2. First, the coaxial cable 20 is inserted through the clamp ring 3, and then, the insertion distal portion 11*a* of the connector main body 30 is inserted between the aluminum laminate foil 6 and the braided conductor 7 from the end portion of the coaxial cable 20, which is peeled by a predetermined length meeting the connector main body 30. Then, when the coaxial cable 20 reaches the insertion stopper portion 11*b* or the inner insulator stopper portion 11*e*, the insertion operation is completed. In this case, the outermost edge of the insertion stopper portion 11*b* may be subjected to, for example, knurling for preventing a slip, or its profile may be formed into a shape of oval or the like. The core wire 4 of the coaxial cable 20 is inserted through the core wire hole lid formed in the inner insulator stopper portion 11*e*, and then, is used as a core conductor of the connector of this first embodiment. Incidentally, the core wire 4 of the coaxial cable 20 is covered with a contact pin 50 as shown in FIG. 3 so as to conductively contact, and thus, may be used as a core conductor. In this case, it is possible to use a core wire material, which is more hard to be bent than a soft steel single wire usually used as a core wire in the coaxial cable 20; therefore, durability can be improved with respect to repetitive plug in-and-out with another object to be connected. Further, the clamp ring 3 previously inserted through the coaxial cable 20 is mounted in a manner that the insertion member 11 fixedly fastens the protective coating portion 8 from the outside, and the braided conductor 7 and the connector main body 30 contact with each other using the elasticity of the protective coating portion 8. The clamp ring 3 is formed so as to have a diameter lager than the coaxial cable 20, and may be fixedly fastened by caulking.

As described above, the connector main body 30 is inserted between the aluminum laminate foil 6 and the braided conductor 7; therefore, the inner surface of the insertion member 11 contacts with the outer peripheral surface of the aluminum laminate foil 6 of the coaxial cable 20 so that no clearance is formed. By doing so, a firmly contact state can be obtained. Moreover, the clamp ring 3 is fixedly fastened from the outside of the protective coating portion 8, and thereby, it is possible to securely provide a firmly contact state of the outer peripheral surface of the insertion member 11 with the inner peripheral surface of the braided conductor 7 while tightly fastening the braided conductor 7 and the protective coating portion 8. In addition, the connector is mounted to the coaxial cable 20 in a state that a tensile strength of the braided conductor 7 and the protective coating portion 8 is given; therefore, it is possible to secure a connection by mechanical joint hard to be removable.

The inner surface of the connective cylinder 2 is formed with a threaded portion having a usually used pitch so as to be screwed onto another object to be connected. Simultaneously, the connective cylinder 2 conductively contacts with an outer conductor of another object to be connected by the contact with the above threaded portion. In this case, the connective cylinder 2 may be subjected to knurling for preventing a slip, and its profile may be formed into a shape of oval or the like.

Figure 4:
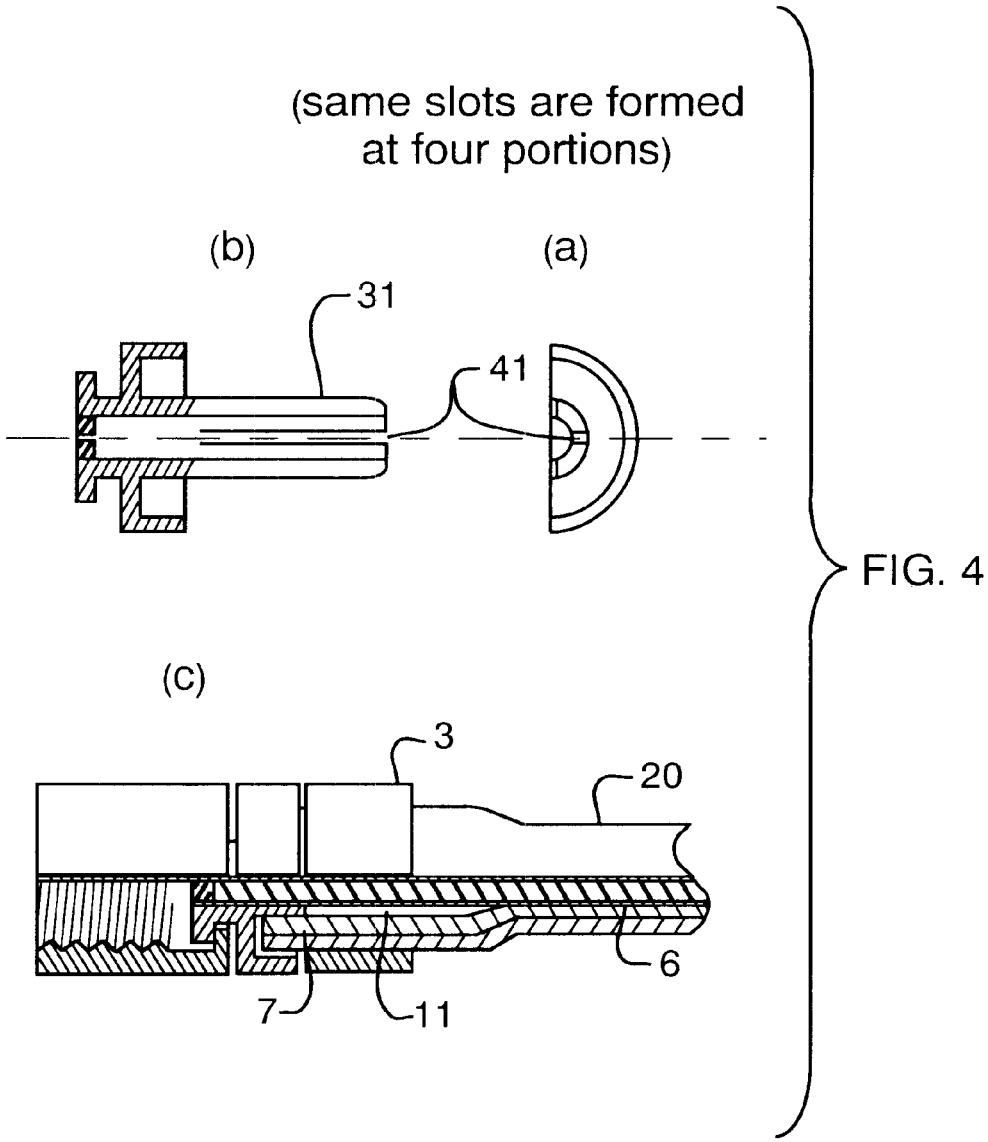
FIG. 4 shows a coaxial cable connector according to a second embodiment of the present invention.

Next, a second embodiment of the present invention will be described below with reference to FIG. 4. FIG. 4(*a*) and FIG. 4(*b*) are front view and side view showing a connector main body 31 according to this second embodiment, respectively. FIG. 4(*c*) is a side view partially in section showing a state that the connector main body 31 is inserted and mounted to a coaxial cable 20. In the connector main body 31, at least four slots 41 are provided at the insertion distal portion 11*a* of the connector main body 30 shown in FIG. 1 and FIG. 2. In this second embodiment, the slot 41 is provided, and thereby, the following effect can be obtained. More specifically, in the insertion member 11, a stress to the axial direction generated by firmly fastening the clamp ring 3 serves to make a firmly contact state of the braided conductor 7 with the insertion member 11, and further, to make small a width of slot. In other words, a circumferential diameter of the insertion member 11 can be made small. Therefore, the insertion member 11 and the aluminum laminate foil 6 are firmly fixed, so that the connector can be more firmly mounted. In this case, the number of slots is not limited to four; for example, two slots may be formed.

Figure 5:
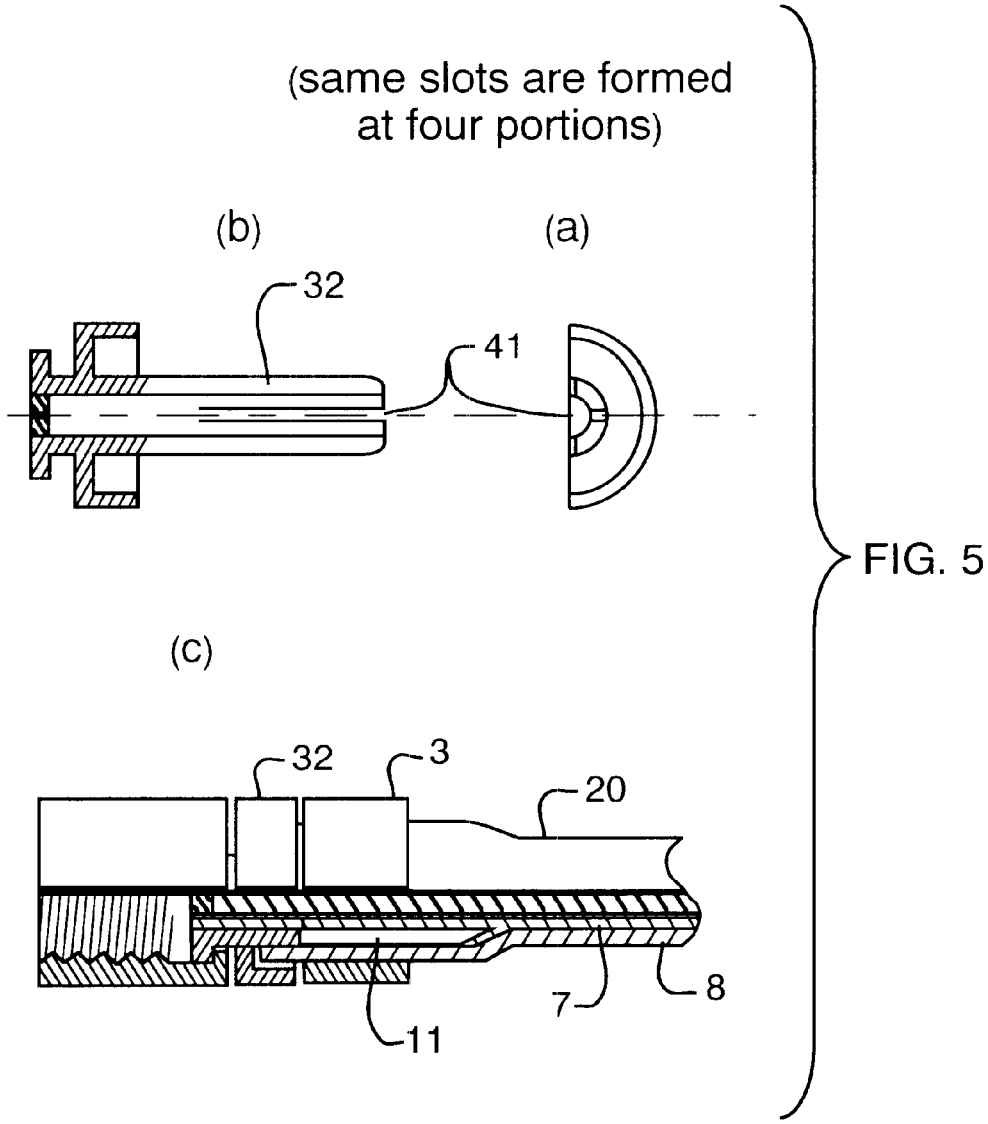
FIG. 5 shows a coaxial cable connector according to a third embodiment of the present invention.

Next, a third embodiment of the present invention will be described below with reference to FIG. 5. FIG. 5(*a*) and FIG. 5(*b*) are front view and side view showing a connector main body 32 according to this third embodiment, respectively. FIG. 5(*c*) is a side view partially in section showing a state that the connector main body 32 is inserted and mounted to a coaxial cable 20. The connector main body 32 has the same structure as the above connector main body 30, and differs from the connector main body 30 in the following points. More specifically, the insertion member 11 of the connector main body 32 is inserted between the braided conductor 7 and the protective coating portion 8 of the coaxial cable 20, and further, is provided with the same slots 41 as described in the second embodiment. According to this third embodiment, the connector main body 32 is inserted between the braided conductor 7 and the protective coating portion 8, and thereby, the clamp ring 3 is firmly fixed from the outside of the protective coating portion 8, so that the protective coating portion 8 can be tightly fastened. Further, the connector 32 is mounted to the coaxial cable 20 in a state that a tensile strength of the protective coating portion 8 is given; therefore, it is possible to secure a connection by mechanical joint hard to be removable. Further, the slot 41 is provided, and thereby, the braided conductor 7 is tightly fastened from the outside. Therefore, this serves to securely make a contact of the inner peripheral surface of the insertion member 11 with the outer peripheral surface of the braided conductor 7, and to reduce a clearance generated between a plurality of single wires constituting the braided conductor 7. Accordingly, the connector main body 32 can be mounted in a state that there is no clearance between the connector 32 and the braided conductor 7. In addition, the connector 32 can be mounted in a state that a tensile strength of the braided conductor 7 is given. In this case, the connector main body 32 is inserted between the braided conductor 7 and the protective coating portion 8; therefore, the same effect can be obtained in a coaxial cable having no laminate foil.

Figure 6:
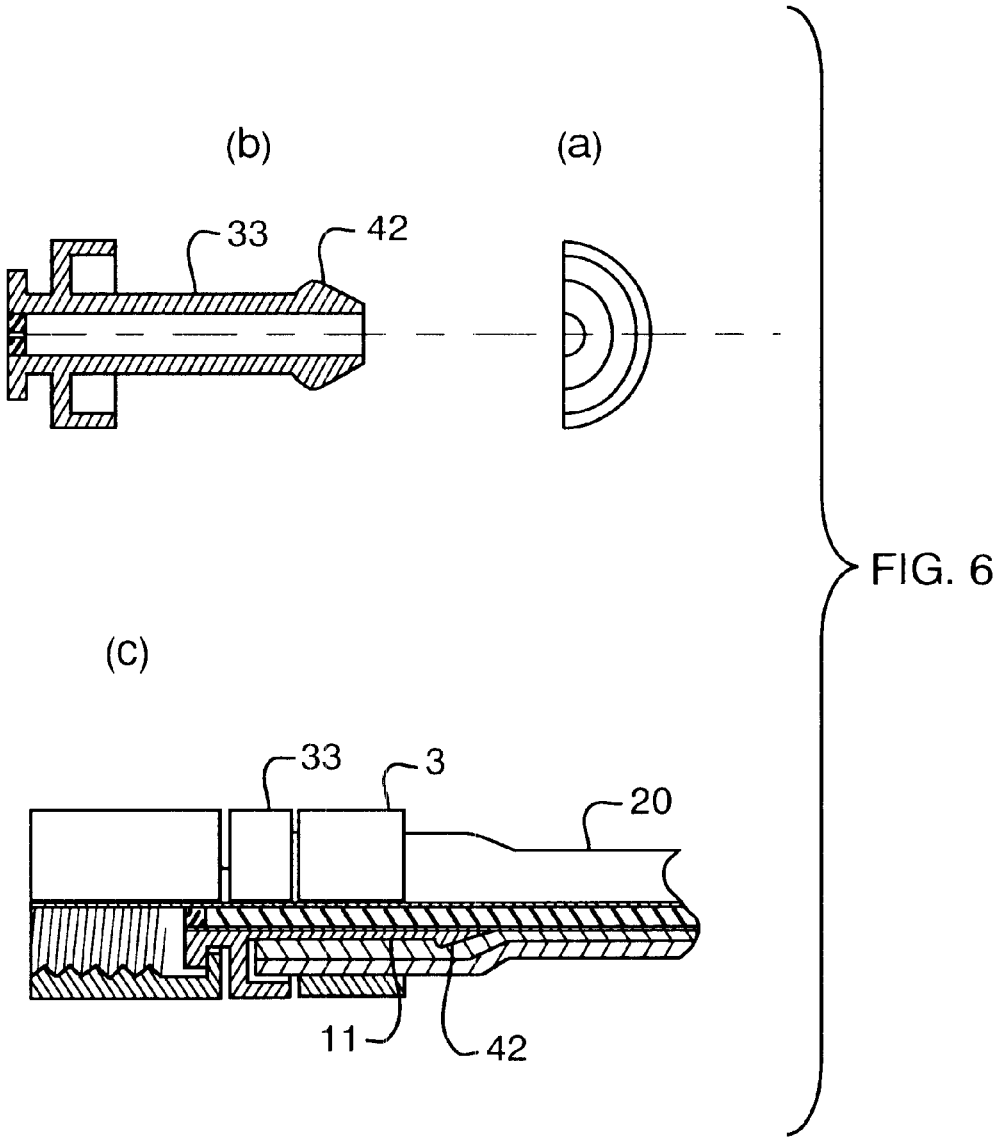
FIG. 6 shows a coaxial cable connector according to a fourth embodiment of the present invention.

Next, a fourth embodiment of the present invention will be described below with reference to FIG. 6. FIG. 6(*a*) and FIG. 6(*b*) are front view and side view showing a connector main body 33 according to this fourth embodiment, respectively. FIG. 6(*c*) is a side view partially in section showing a state that the connector main body 33 is inserted and mounted to a coaxial cable 20. As shown in FIG. 6, the connector main body 33 is constructed in a manner that a ridge portion 42 is formed over the entire circumference of the insertion distal portion 11*a* of the connector main body 30 shown in FIG. 1 and FIG. 2. According to this fourth embodiment, the ridge portion 42 has a circumferential diameter larger than the cylinder diameter in the vicinity of the insertion member 11 into which the clamp ring 3 is fitted. Thus, so long as the clamp ring 3 keeps its shape after being fitted, the coaxial cable 20 is hard to be removed from the connector main body 33.

Figure 7:
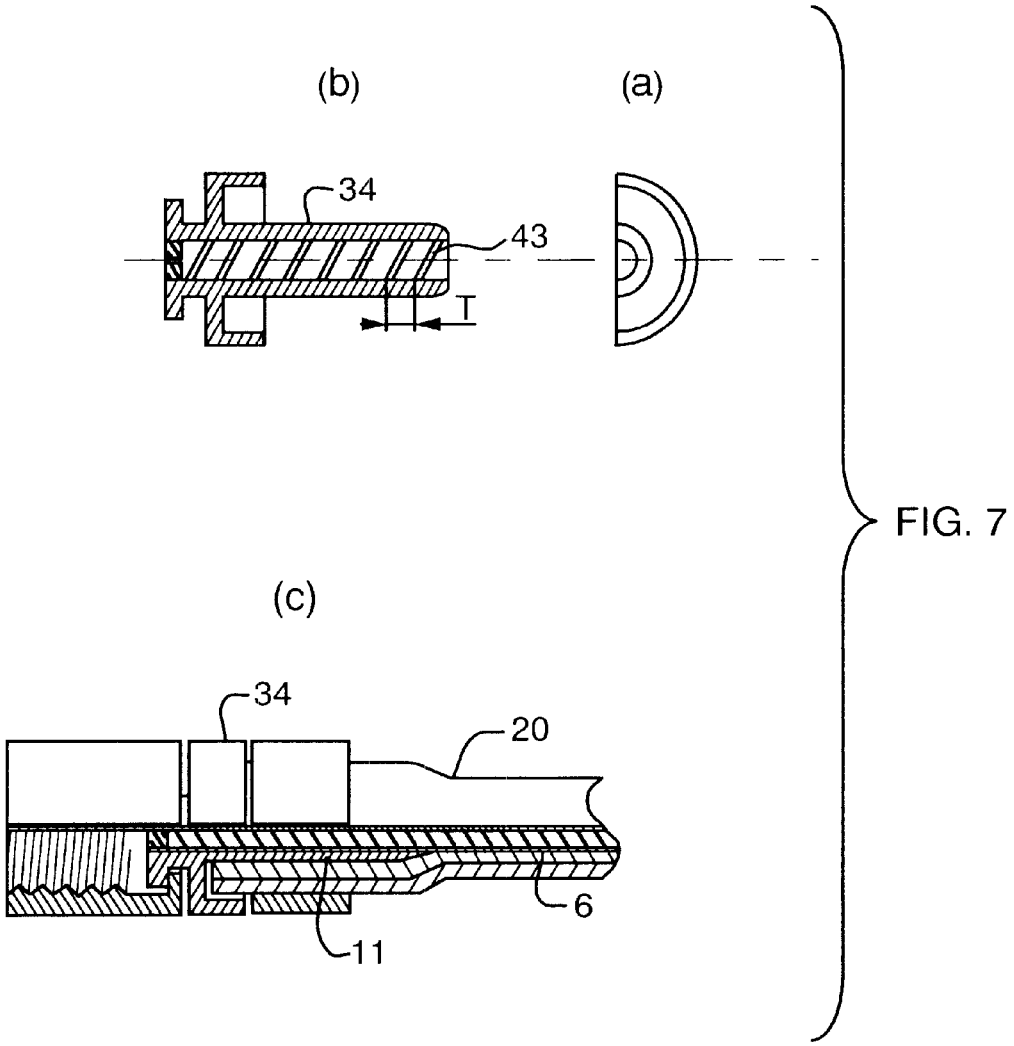
FIG. 7 shows a coaxial cable connector according to a fifth embodiment of the present invention.

Next, a fifth embodiment of the present invention will be described below with reference to FIG. 7. FIG. 7(*a*) and FIG. 7(*b*) are front view and side view showing a connector main body 34 according to this fifth embodiment, respectively. FIG. 7(*c*) is a side view partially in section showing a state that the connector main body 34 is inserted and mounted to a coaxial cable 20. The connector main body 34 is constructed in a manner that a spiral protrusion 43 is formed at the inner surface of the insertion member 11 of the connector main body 30 shown in FIG. 1 and FIG. 2. According to this fifth embodiment, the spiral protrusion 43 formed at the inner surface of the insertion member 11 forms a spiral notch engaging with it at the outer peripheral surface of the aluminum laminate foil 6 of the coaxial cable 20. The spiral protrusion 43 is engaged with the spiral notch, and thereby, it is possible to securely make a contact with the aluminum laminate foil 6, and thus, to obtain a firmly contact state without clearance. More specifically, the spiral protrusion 43 formed at the inner surface of the insertion member 11 is more firmly engaged with the aluminum laminate foil 6; therefore, the whole of the inner surface firmly contacts with the laminate foil 6 with less clearance. Moreover, the connector main body 34 is inserted while rotating around the axis according to the spiral protrusion 43; therefore, it is possible to readily insert the connector main body 34 into the coaxial cable 20 in a manner of driving a screw. In order to carry out the insertion into the coaxial cable 20 faster, a pitch T of the spiral protrusion 43 formed at the inner surface of the insertion member 11 may be made coarse. In addition, the spiral protrusion 43 may be formed partially, and not continuously.

Figure 8:
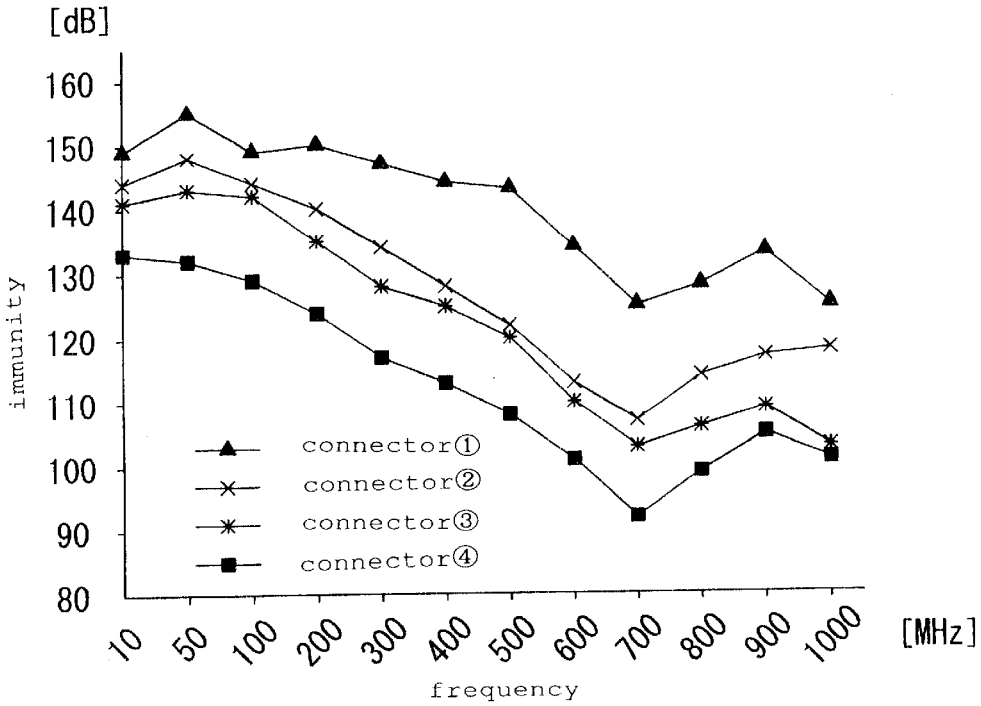
FIG. 8 is a graph showing a frequency characteristic of shielding performance of the connector according to the present invention and a conventional connector.

FIG. 8 is a graph showing a frequency characteristic of shielding performance of the connector according to the fifth embodiment and a conventional connector. In this case, as the connector of the fifth embodiment, the following connectors ① to ③ have been used:

① connector which is formed with a threaded portion having a pitch of 0.5 as the continuously spiral protrusion 43 formed at the inner surface of the insertion member 11;

② connector which is formed with a slot 41 at a position dividing the insertion member 11 into two parts in the axial direction; and ③ connector which is formed with a slot 41 at a position dividing the insertion member 11 into four parts in the axial direction.

Moreover, as the conventional connector, the following connector ④ has been used:

④ connector having the same structure as the connector disclosed in the above Unexamined Patent Publication No. 57-105985; more specifically, the connector is constructed in a manner of firmly fastening a plurality of conductors covering the braided conductor portion of the coaxial cable using a clamp ring.

When making a comparison of frequency characteristic of shielding performance between the above connectors, it has been found that the connectors ①, ② and ③ of the above embodiments individually have the shield effect superior to the conventional connector ④. Namely, these connectors ①, ② and ③ can exhibit their ability within a transmission frequency band of 10 to 770 MHz.

As is evident from the above description, according to the first aspect of the present invention, the connector main body is inserted between the laminate foil and the braided conductor, and thereby, the connector is securely connected to the coaxial cable without clearance; therefore, no influence of noise is given from the outside. Conversely, no signal leaks from the coaxial cable. Moreover, the braided conductor and the protective coating portion are tightly fastened from the outside using the clamp ring, and thereby, the connector is mounted to the coaxial cable in a state that a tensile strength of the braided conductor and the protective coating portion is given. Therefore, it is possible to realize a connection excellent in a fixing force hard to be removed.

According to the second aspect of the present invention, in addition to the effect of the above first aspect, the slot is formed, and thereby, the inner diameter of the insertion member of the connector main body is variable. Therefore, the clamp ring is more firmly fitted; as a result, it is possible to realize a connection excellent in a fixing force.

According to the third aspect of the present invention, the connector main body is inserted between the braided conductor and the protective coating portion. Thereafter, these members are tightly fastened from the outside of the protective coating portion using the clamp ring, and thereby, a tensile strength of the protective coating portion is given to the mounting to the coaxial cable. Therefore, a connection excellent in a fixing force hard to be removed is possible. Moreover, the slot is formed, and thereby, the inner diameter of the insertion member of the connector main body is variable. Therefore, the clamp ring is more firmly fitted, and in addition, the tensile strength of the braided conductor is given; as a result, a fixing force by the clamp ring is improved. Further, the connector main body and the braided conductor more firmly contact with each other, and the connector is connected to the coaxial cable without clearance; therefore, no influence of noise is given from the outside. Furthermore, no signal leaks from the coaxial cable.

According to the fourth aspect of the present invention, in addition to the effect of the first to third aspects, the distal ridge portion of the connector main body can prevent the clamp ring from being removed; therefore, it is possible to provide a connection excellent in a fixing force by the clamp ring.

According to the fifth aspect of the present invention, in addition to the effect of the first to fourth aspects, the spiral protrusion of the insertion member is engaged with the notch of the laminate foil formed by the protrusion. Therefore, it is possible to provide a connection more excellent in a fixing force, and to readily insert the connector main body into the coaxial cable.

What is claimed is:

1. A coaxial cable connector, which is mounted to an end portion of a coaxial cable including a braided conductor and a laminate foil provided on the inner side of the braided conductor and having a conductivity, comprising:

a cylindrical connector main body inserted between the braided conductor and a protective coating portion provided outside the braided conductor;

a connective cylinder rotatably supported to a proximal portion of the connector main body so as to be engaged with an outer conductor of a mating connector to be connected; and a clamp ring for fixedly fastening and insertion member of the connector main body after being inserted into the coaxial cable, a distal end portion of the connector main body inserted into the coaxial cable being formed with a slot.

2. The coaxial cable connector according to claim 1, wherein a ridge portion is formed at an outer peripheral portion in the vicinity of the distal portion of the connector main body.

3. The coaxial cable connector according to claim 1, wherein an inner surface of the connector main body is formed with a spiral protrusion.

* * * * *